United States Patent [19]

Esser et al.

[11] Patent Number: 5,003,675

[45] Date of Patent: Apr. 2, 1991

[54] SEPARATOR FOR SEAMING MACHINES

[75] Inventors: Klaus Esser; Hans-Eugen Hacker, both of Reutlingen, Fed. Rep. of Germany

[73] Assignee: Herman Wangner GmbH & Co. KG, Fed. Rep. of Germany

[21] Appl. No.: 495,963

[22] Filed: Mar. 20, 1990

[30] Foreign Application Priority Data

Mar. 20, 1989 [DE] Fed. Rep. of Germany ..... 8903454

[51] Int. Cl.[5] ..... D03D 41/00; D03D 3/04

[52] U.S. Cl. ..... 28/141; 28/202

[58] Field of Search ..... 28/141, 201, 202, 203, 28/204, 205, 206, 207

[56] References Cited

U.S. PATENT DOCUMENTS

| | | | |
|---|---|---|---|
| 977,166 | 11/1910 | Colman | 28/202 |
| 1,207,249 | 12/1915 | Wenzel | 28/202 |
| 2,313,195 | 4/1941 | Fleischer et al. | 28/202 |
| 4,581,794 | 4/1986 | Oldroyd et al. | 28/141 |
| 4,736,499 | 4/1988 | Köpcke | 28/141 |
| 4,860,411 | 8/1989 | Vöhringer | 28/202 X |
| 4,866,821 | 9/1989 | Häcker | 28/202 X |

*Primary Examiner*—Werner H. Schroeder
*Assistant Examiner*—Bradley Kurtz DeSandro
*Attorney, Agent, or Firm*—Sughrue, Mion, Zinn Macpeak & Seas

[57] ABSTRACT

A separator for successively seizing threads held in an array includes a frame, in which at least one plate is guided for seizing the threads. The frame is displaceable toward and away from the array. Each plate carries a piercing needle which pierces the thread for seizing it. Each plate can have two piercing needles disposed at a distance from one another and pointing towards one another.

6 Claims, 6 Drawing Sheets

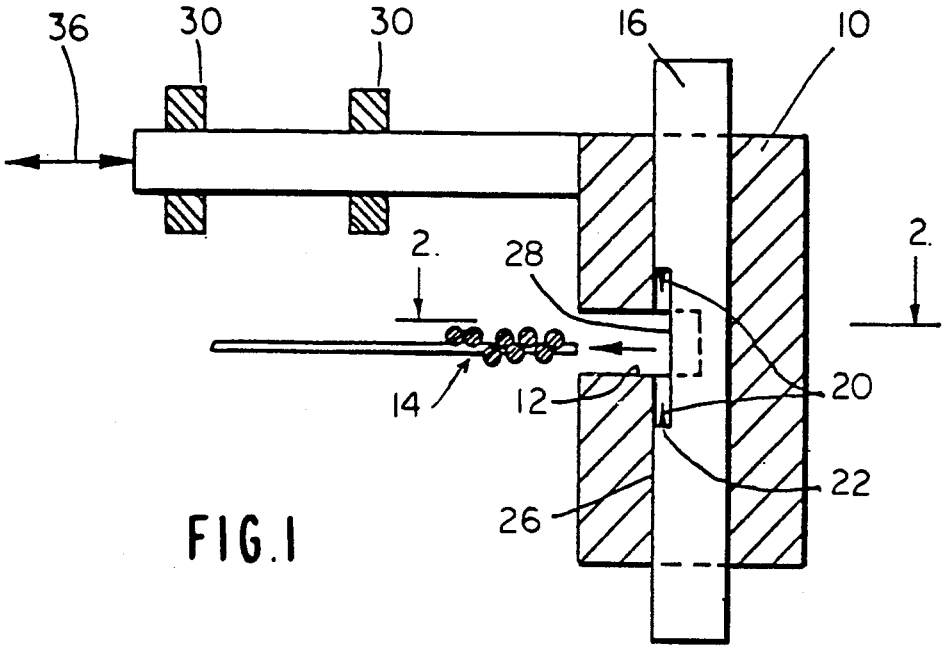
FIG.1
FIG.5
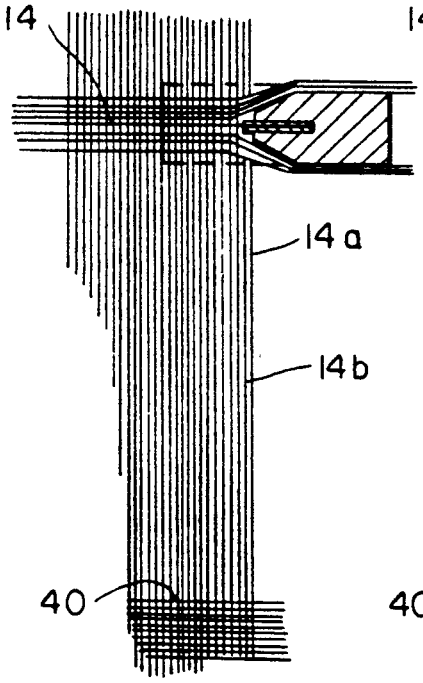
FIG.6
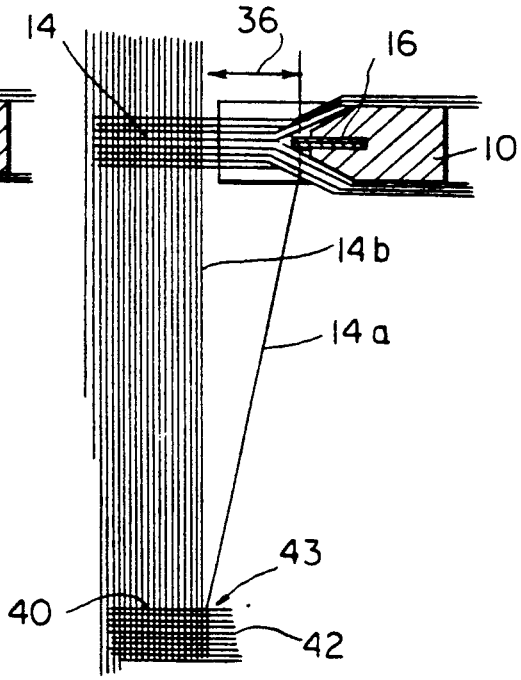

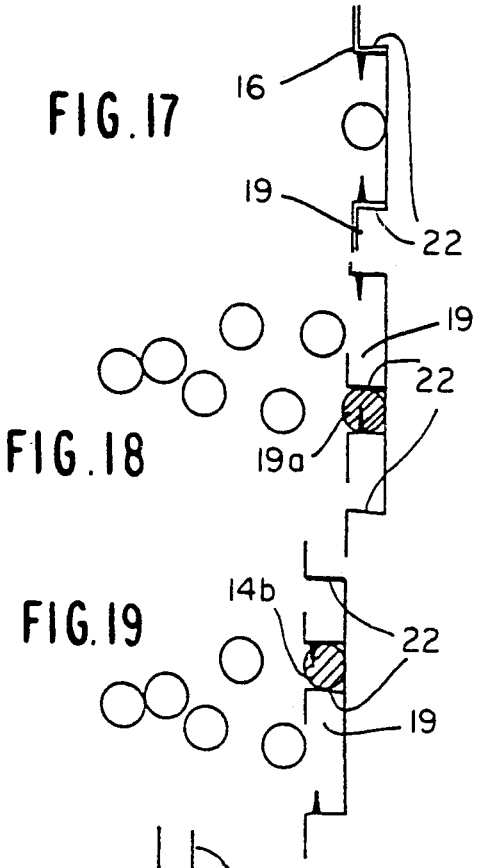
FIG. 17
FIG. 18
FIG. 19
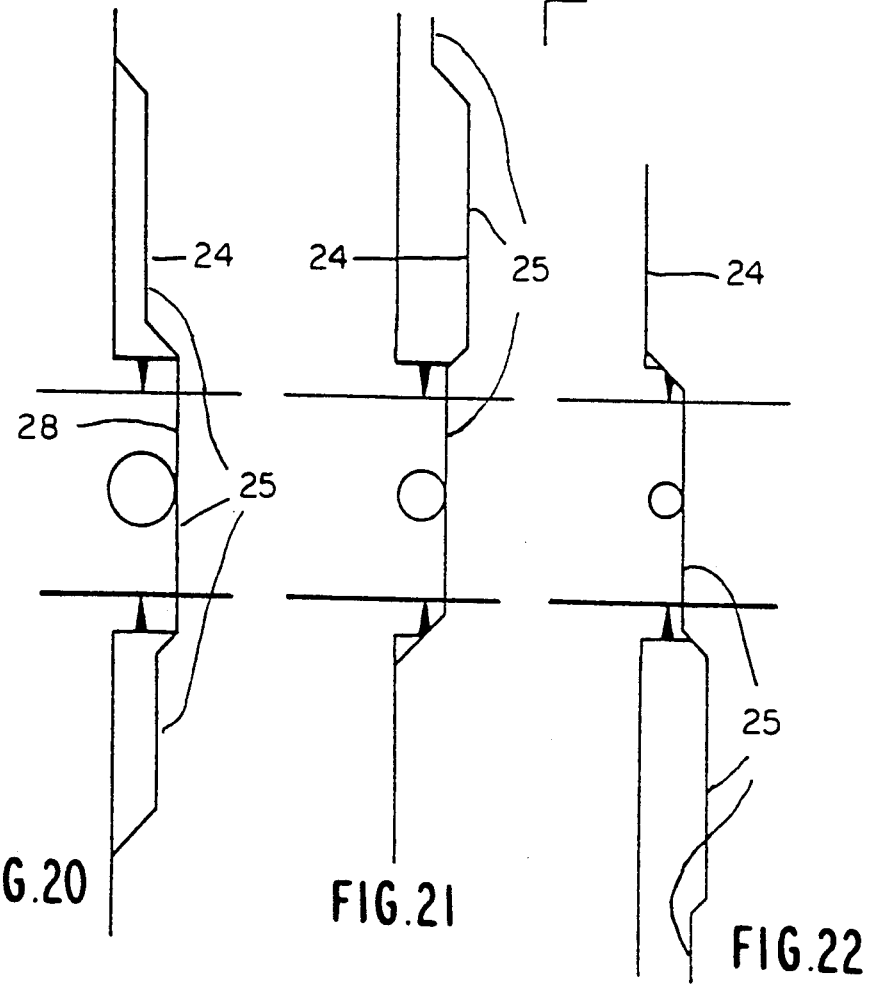
FIG. 20
FIG. 21
FIG. 22

SEPARATOR FOR SEAMING MACHINES

BACKGROUND OF THE INVENTION

This invention relates to a separator for successively seizing threads held in an array. The separator includes a frame in which at least one plate is guided for seizing the foremost thread in the array and is adapted to be displaced by a drive means.

In separators of this type of design such as known from DE-U-87 06 649, DE-A-37 12 169, DE-A-37 14 517, EP-A-289 640, and EP-A-301 174, as well as co-pending U.S. patent application Ser. No. 222 860, now U.S. Pat. No. 4,866,821, filed July 22, 1988, each plate is formed to have one or two hooks adapted to the diameter of the thread to be seized. Adaptation to the thread diameter must be very precise in that regard so as to achieve secure seizing of the foremost thread to be separated and to prevent any taking along of the thread which follows next. It is necessary, therefore, to exchange the plate in the event of a change as to thread diameter.

In separators according to DE-U-81 22 450, DE-U-87 06 649, DE-A-37 14 517 and EP-A-289 640 the thread to be taken up is seized in that it is urged by the hook against the frame. The thread to be taken up is seized between oppositely directed hooks carried by at least two plates in the case of the separators according to U.S. patent application Ser. No. 222,860 and EP-A-301 174, with one of the hooks being conformed to the diameter of the thread to be separated and the other hook co-operating therewith being of about half the size. The smaller hook pierces the thread at about half the width and urges said thread into the larger hook. With plates having hooks, the positive engagement can extend maximally only over half the circumference. Threads which are woven securely into the array can, therefore, not be reliably separated.

SUMMARY OF THE INVENTION

The present invention is based on the problem of improving a separator of the type set forth at the outset in a manner such that it is suited for seizing threads of varying diameters. This problem is solved according to the invention in that the plate includes a piercing needle which pierces or bites into a thread in order to seize it.

The separator according to the invention is suited for thread diameters which deviate from one another by up to about 50%. Separators of that type form component parts of a seam weaving machine for rendering the sheet-forming fabrics for papermaking machines endless. The array of the threads is a magazine-type thread holding band, in which the longitudinal threads of the sheet forming fabrics are held by being interwoven with transverse threads. For making the woven seam, the longitudinal threads must be individually taken one after the other out of the magazine-type holding band, i.e., separated. The longitudinal threads of such sheet forming fabrics in most instances have diameters ranging from about 0.15 to 0.22 millimeters and in extreme cases ranging from about 0.10 to 0.35 mm.

The plate has a base edge which the thread to be separated engages before the piercing needle pierces or bites into the thread and seizes the thread upon displacement of the plate. The plate is designed such that the piercing needle is spaced from the base edge a distance amounting to about ¾ of the lower limit and about ½ of the upper limit of the range of thread diameters which is to be processed. If, for instance, the range of thread diameters to be covered is from 0.15 to 0.22 mm, the piercing needle must be positioned from the base edge at a distance of approximately 0.11 mm.

Apart from the fact that the plates are designed to have a piercing needle instead of a hook conformed to the diameter of the thread to be seized, the separator of the invention corresponds to the separator disclosed in EP-A-301 174. In principle, the separator may be designed in two different ways.

In the first type of design, which is disclosed in DE-U-81 22 450, the frame of the separator has two legs defining between them a gap which is a little wider than the thickness of the thread array. The separator is moved forwardly far enough for the base edge of the plate to engage the foremost thread to be separated with a predetermined, defined force. As the plate is displaced by the drive means in a seizing stroke, the piercing needle bites into the foremost thread in the array and urges it against one of the legs of the gap. In that way, the foremost thread is seized. The separator is moved back and away from the array with the seized thread so that the foremost thread is then pulled in a separating stroke out of the array so that it can be gripped by the known grippers of a seam weaving machine and further processed. Expediently, the plate is provided with two piercing needles, which are spread apart a distance corresponding approximately to the width of opening, e.g., 1.2 mm, and are pointing towards one another so as to respectively use the piercing needle positioned on the side of the foremost thread facing away from the thread that follows. In the event of a very high thread density of the sheet forming fabric, this ensures the penetration of the needle into the foremost thread of the array instead of into the thread that follows.

On account of the fact that the spacing of the piercing needle from the base edge is maximally about ¾ the thread diameter, penetration of the needle into the thread that follows is with certainty ruled out. Once the piercing needle has penetrated into the foremost thread of the array, any penetration into the following thread is ruled out since the piercing needle no longer lies exposed. In the case of the separators disclosed in the above-mentioned publications and application having hooks conformed to the thread diameters, the pointed end of the hook, by contrast, lies exposed after a thread has been seized and can, at the very worst, penetrate into the next following thread and hold onto it and in that way separate it along with the preceding thread. The consequence of this would be a disturbance of the seam.

Any splitting of the seized thread must of course be avoided. To that end, the piercing force of the piercing needle can be limited by means of a pressure regulator. The cone angle of the tip is likewise of significance in this respect. It should be about 30°. The free length of the piercing needle should in this respect be somewhat less than the thread diameter. The tip of the piercing needle must be designed to be very pointed, so that it can bite into the thread with a slight force so that said thread cannot evade the needle. Penetration of the piercing needle into the thread serves to achieve firm, positive engagement, which prevents the thread becoming released from the piercing needle upon separation from the fabric.

In the other type of design of the separator, piercing needles bite into the thread to be separated on opposite sides so that the thread is held between the two piercing needles. The thread therefore is, in contrast to the first-mentioned type of design, not urged against a leg of the gap so that there is no need for the frame of the separator to include such legs. In order to prevent any tilting of the thread, it is expedient for two piercing needles to bite into it on one side and for one piercing needle disposed therebetween to bite into it on the other side. This mode of procedure is described in detail in EP-A-301 174 in conjunction with FIG. 5. It is of advantage in that regard that the piercing needles approach the thread to be separated and seize said thread in its position such as it is predetermined by the weave pattern. Hence, the thread to be separated is not lifted out of the plane of the array upon the seizing stroke and is, therefore, not urged into the crimp structure of the transverse threads of the array. Urging of the thread to be separated into the crimp structure of the transverse threads on occasion has the consequence in the case of the first type of design of the separator that the thread to be separated is not released from the weave pattern upon the separating stroke. Another advantage of this mode of operation is that arrays having a very firm weave pattern can be processed, e.g., magazine-type thread holding bands, in the case of which the thread to be separated is woven-in by transverse threads on the running side as well as also on the paper side. It is also possible in the case of these fabrics to remove a portion of the transverse threads, e.g., the transverse threads on the paper side, for formation of the magazine-type thread holding band, so that the longitudinal threads may be more loosely woven in. The sequence of the longitudinal threads is not destroyed in that respect.

In two-layer fabrics, the paper side is generally securely woven in, e.g., by a linen weave, while the running side is loosely woven (twill weave) for achieving long transverse thread floats. In magazine-type thread holding bands, a single piercing needle expediently bites first into the longitudinal thread on the running side that is loosely woven-in, namely on the side facing away from the paper side and separates it. Two counter-engaging piercing needles then bite into the corresponding longitudinal thread on the paper side and separate it. The corresponding longitudinal thread on the running side can in that regard no longer cause any disturbance since it has already been separated.

In the first type of design as well as in the second type of design there may be utilized one or more plates with respectively one piercing needle or two opposing piercing needles. The embodiment of the second type of design with three plates, which respectively have two oppositely directed piercing needles is the one which is most advantageous. This makes it possible to at first bite into each thread with the center plate on the side facing away from the thread that follows, so that there is no risk of biting into the subsequent thread before the piercing needle reaches the foremost thread. Depending upon the density of the threads in the array and the weave pattern, the piercing needles of the two lateral plates engaging from the other side must be moved at a relatively small distance past the thread that follows so as to allow them to pierce into the foremost thread. Hence, there is a particularly high risk in the case of these two piercing needles that they bit into the thread that follows and seize it. In order to avoid this, the piercing needles of the two lateral plates are expediently disposed at a somewhat smaller distance from the base edge. As already mentioned, each thread is, in the case of the embodiment according to this second type of design, firmly seized between two of three piercing needles, in the position which the thread has in the fabric. For firm seizing, the thread need not, as in the case of the first type of design, be urged against one of the two legs of the gap. Upon the subsequent separating stroke, the firmly seized thread is easily released from the weave pattern.

If the separator is to be suited for a particularly wide range of thread diameters, there may additionally be provided a stepped plate such as disclosed in EP-A-301 174.

BRIEF DESCRIPTION OF THE DRAWINGS

Illustrative embodiments of the invention shall be explained below by way of the drawings wherein:

FIG. 1 is a vertical sectional view of a separator with a plate having two opposing piercing needles;

FIGS. 5 and 6 are horizontal sectional views of the separator taken along the line 2—2 in FIG. 1 showing the separating stroke in sequence;

FIGS. 17 to 19 are sequential schematic views showing the mode of operation of a separator having one plate, which includes two opposing piercing needles, and one or two further plates without any piercing needle;

FIGS. 20 to 22 are schematic views showing the use of separators each having a modified stepped plate for threads of very different diameters;

DETAILED DESCRIPTION OF THE INVENTION

Figure 4:
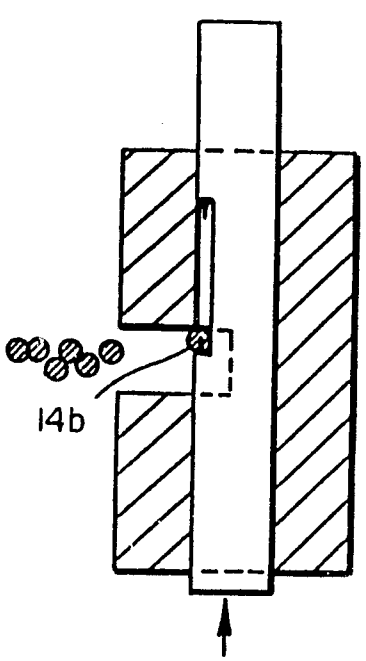
FIGS. 2 to 4 are sequential views similar to FIG. 1, showing the operating steps of firmly seizing and separating the foremost thread of the array.

FIGS. 1 to 6 show, in vertical and horizontal section, a separator which includes a frame 10, in which a displaceable plate 16 is guided in the vertical direction. Frame 10 has the shape of a block with a slot extending centrally in the vertical direction for receiving plate 16. On the side facing the threads of an array 14, the frame 10 has a gap 12 at about half its height, which gap is defined by a horizontal cutout extending over the full width. The gap 12 extends into the center of the block, so that the plate 16 lies exposed in the gap 12. Frame 10 is displaceable in the horizontal direction, i.e., in parallel to the plane of the array 14, by means of a conventional drive element, not shown, for instance a pneumatic cylinder, so as to perform a separating stroke 36. In that regard, frame 10 is guided by means of separating stroke guides 30.

Plate 16 is a flat steel strip of a thickness of, for instance, 0.25 millimeters, whose front edge 26 is set back in the portion visible in the gap 12 so as to form a base edge 28. The upper and lower ends of the base edge 28 are joined by horizontal steps 22 to the front edge 26.

Piercing needles 20 directed vertically upwardly and downwardly, respectively, are disposed at a distance from the base edge 28 which corresponds to about ⅔ of the diameter of the threads of the array 14 which are to be separated. A customary diameter is 0.15 mm so that the distance of the tips of the piercing needles 20 from the base edge 28 is then 0.11 mm. The piercing needles 20 may, for example, be the tips of sewing needles which are glued into recesses in the horizontal steps 22 or are attached by means of spot welding. Another possibility of producing the tips of the piercing needles is wire-EDM (electrical discharge machining).

Figure 3:
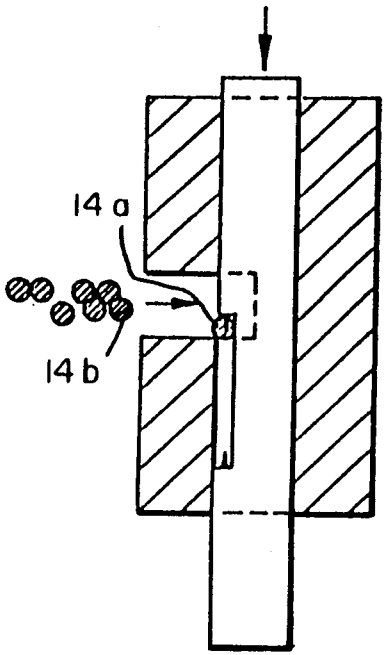
Figure 2:
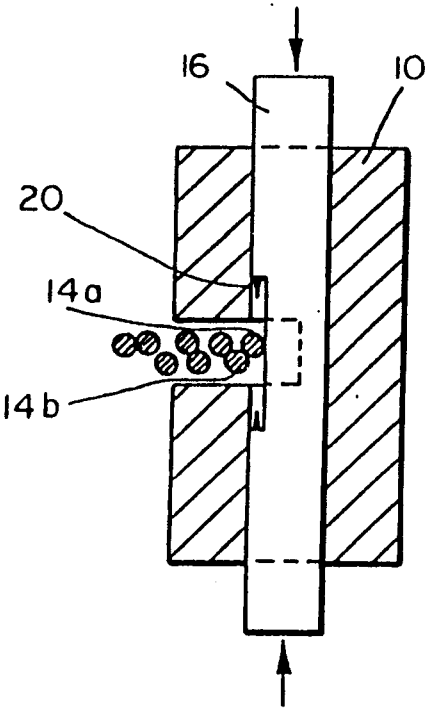

The individual operating steps of the separator are depicted in FIGS. 1 to 3. As indicated by the arrow in FIG. 1, frame 10 of the separator is slid within the separating stroke guides 30 forwardly toward the foremost thread 14*a* of the array. Plate 16 is disposed in its center position during movement. In FIG. 2, the frame 10 has reached its forward end position, in which the base edge 28 is in engagement with the foremost thread 14*a*. By displacement of plate 16, one of the two piercing needles 20 can then bite into the foremost thread 14*a* and hold it against the lower or upper edge of gap 12. During the seizing operation, the thread to be separated is limited as to its movement by the base edge 28 and the thread which follows and therefore cannot evade the piercing needle 20. On account of the crimping of the threads within the weave pattern of the papermaking machine forming fabric and the array 14. i.e., the magazine-type thread holding strip, the threads to be separated are located at different heights. The threads are in that regard arranged so close to one another that they, when viewed form the top, partly overlap. Therefore, the upper piercing needle 20 bites into the threads arranged somewhat higher and holds them against the lower edge of gap 12, whilst the lower piercing needle 20 bites into the threads arrange somewhat lower and holds them against the upper edge of page 12. In FIG. 2, the foremost thread 14*a* is disposed high up within the array 14 and, therefore, as shown in FIG. 3, the upper piercing needle 20 bites into it and urges it against the lower edge. The thread 14*b* that follows is disposed at a low level within the array 14, and therefore, as shown in FIG. 4, the lower piercing needle 20 bites into it and urges it against the upper edge of gap 12. If the lower piercing needle 20 were used in FIG. 2, there would be a risk that it would bite into the following thread 14*b* and hold it, along with the foremost thread 14*a*, against the upper edge of gap 12. As soon as the foremost thread has been held against the edge of the gap 12, it is separated from the other threads in the array 14 by a separating stroke as indicated by the right end of arrow 36. This parting or separation is necessary for the thread to be able to be gripped by the grippers of a seam weaving machine and introduced into the seam weaving shed. FIGS. 5 and 6 show the separator in the forward and rearward end-positions respectively of the separating stroke. Furthermore, the one end 40 of the fabric may be seen, which is to be connected to the other end, not shown, by means of the weaving seam, so that a continuous band is obtained. The ends of the longitudinal or warp threads 14*a*, 14*b*, etc., are held in the array 14 or the magazine-type thread holding band in the sequence as determined by the weaving pattern. The transverse or weft threads 42 have been removed between the magazine-type thread holding band and the end 40. To loosen the binding within the magazine-type thread holding band, some weft threads 42 can also be removed. The already finish-produced portion of the weaving seam goes up to point 43 and is not shown for reasons of clarity.

Figure 7:
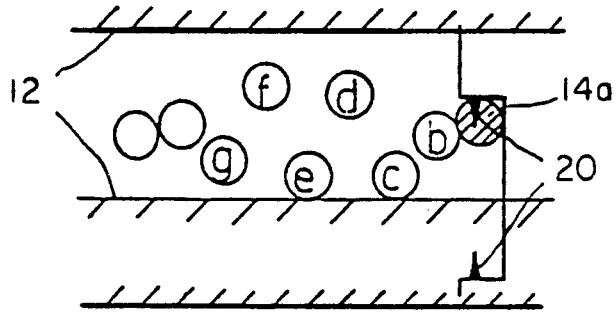
FIGS. 7 to 13 are sequential schematic views showing the mode of operation of the separator in regard to the individual threads of a repeat.
Figure 8:
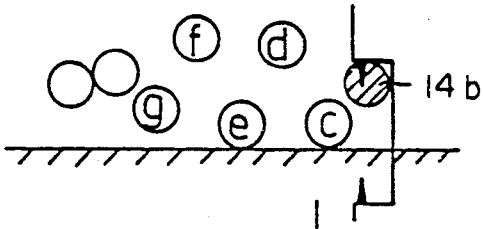
Figure 9:
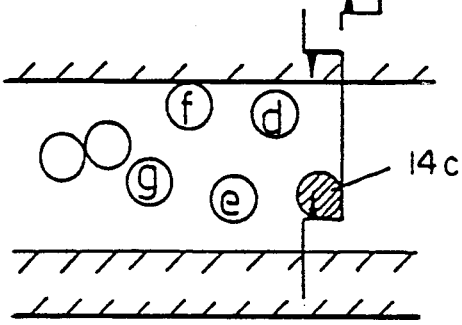
Figure 10:
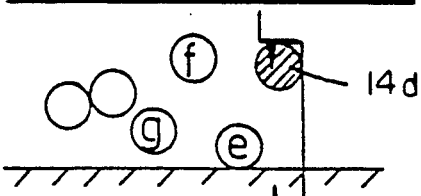
Figure 11:
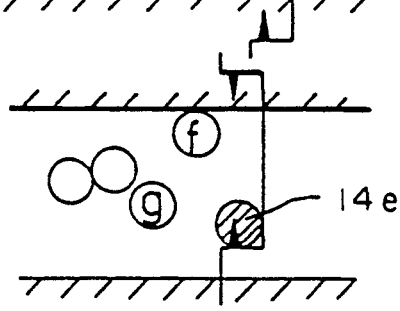
Figure 12:
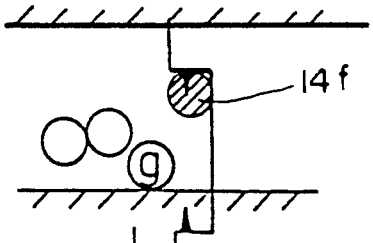
Figure 13:
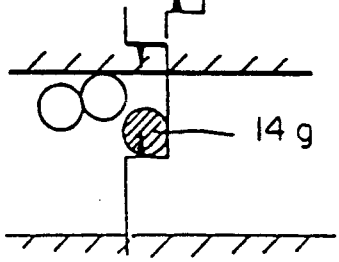

FIGS. 7 to 13 show which of the two piercing needles 20 is used for all the threads 14*a* to 14*g* of a 7-harness weave repeat, i.e., whether plate 16 is moved upwards or downwards. In FIGS. 7 and 8, the upper piercing needle 20 is used and in FIGS. 9–13 that follow, the lower and the upper piercing needles 20 are used alternatingly.

As may be seen in the magnified illustration represented by FIG. 8, thread 14*c* that follows must be pushed back if the foremost thread 14*b* is to be held against the edge of gap 12.

Figure 25:
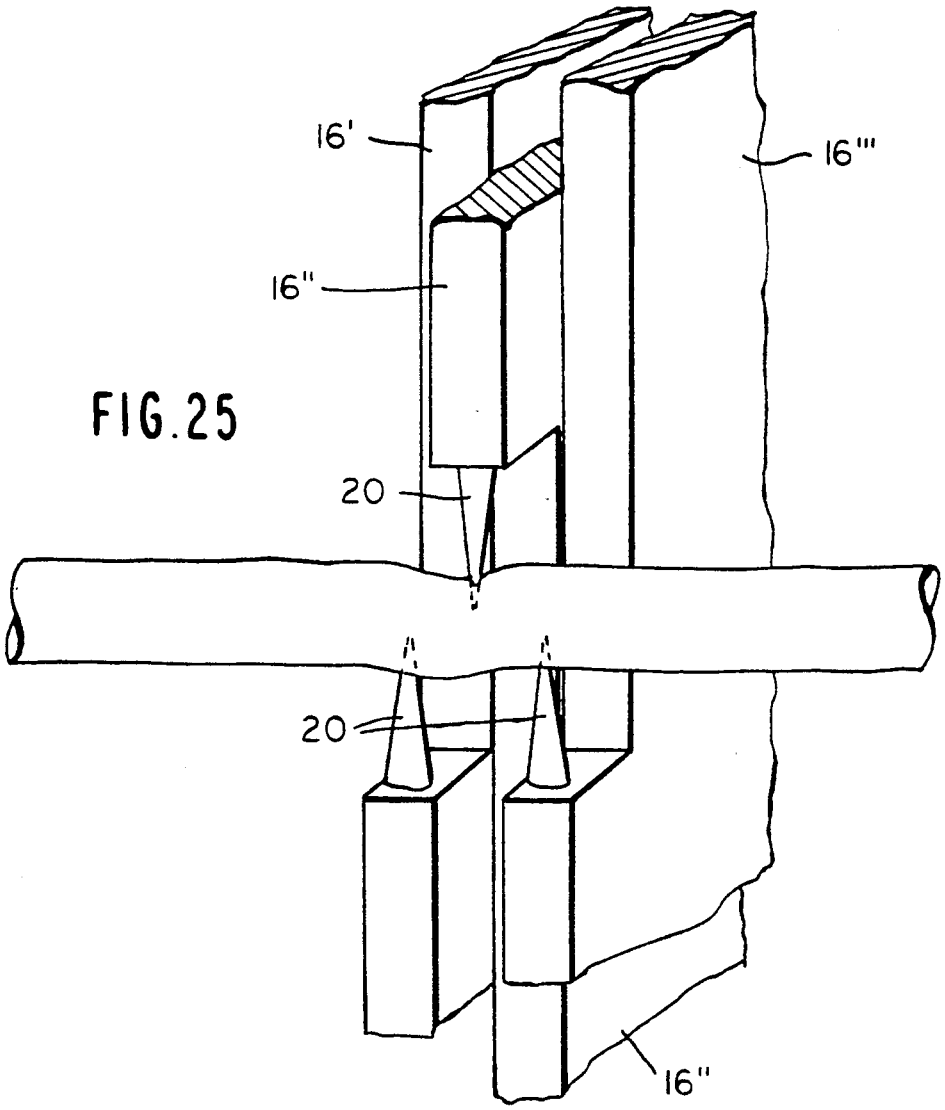
FIG. 25 is a schematic perspective view showing the cooperation of three piercing needles.

Difficulties may arise in conjunction with the separating stroke 36 if the threads are very tightly woven into the array 14. There then is the risk that the already seized, foremost thread is torn out and becomes released from piercing needle 20. It is in such instances more advantageous not to hold the threads against the edge of gap 12 but, rather, to seize them so that piercing needles 20 bite into the thread from above and from below and retain the thread therebetween. Plates 16 are in that regard displaced to varying extents, so that they seize the foremost thread 14*a* (FIG. 15) or 14*b* (FIG. 16) respectively at the height at which it is located within the array 14. The varying displacement of plates 16 in that respect results automatically if pneumatic drive means of the plates are actuated at the same time and at the same pressure. Due to the fact that the two plates 16 and the piercing needles 20 formed thereon are disposed laterally adjacent one another, the points at which the piercing needles 20 bite into the thread are also offset lengthwise of thread 14*a* or 14*b*, respectively. As the piercing needles 20 bite into the thread, it is tilted somewhat in the vertical plane. To avoid this, three plates 16 are expediently used, the two outer plates 16' and 16''' synchronously driven and entering into engagement from one side, while the plate 16'' disposed therebetween engages from the opposite side (FIG. 25).

Figure 14:
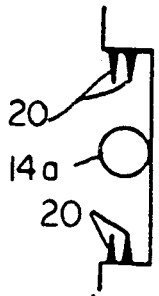
FIGS. 14 to 16 are sequential schematic views showing the mode of operation of a separator having two or three plates and varying spacings of the piercing needles from the base edge.
Figure 15:
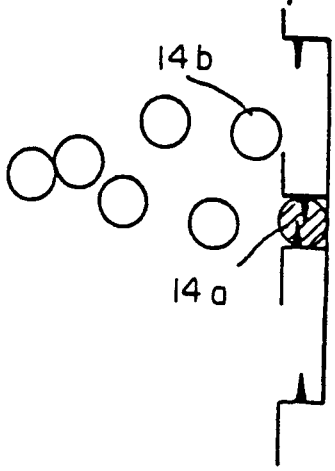
Figure 16:
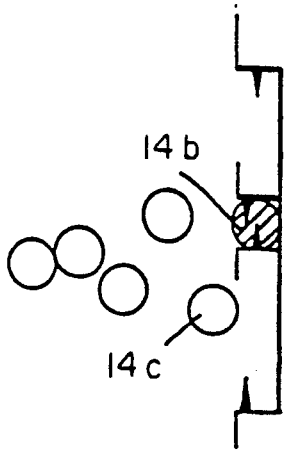
Figure 23:
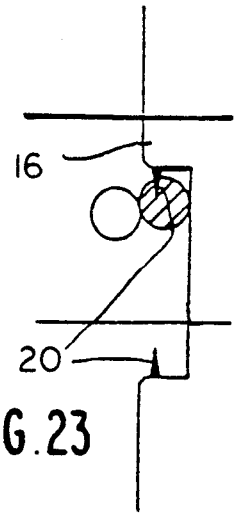
FIGS. 23 and 24 are schematic views showing the use of the separator in the case of threads having diameters varying by about 50%.
Figure 24:
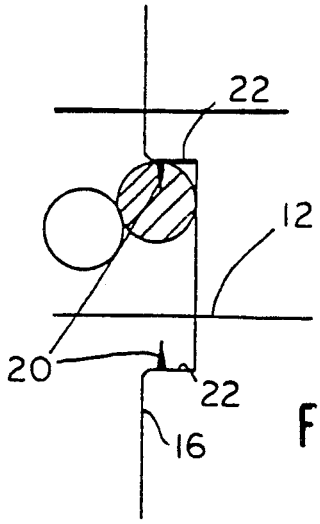

In the embodiment shown in FIGS. 14 to 16, the piercing needles 20 are located at different distances from the base edge 28. For separating threads having a diameter of 0.15 mm and upon the use of a separator having three plates with respectively two piercing needles 20, e.g., the piercing needles 20 of the center plate may be spaced from the base edge 28 by a distance of 0.11 mm. corresponding to about ⅔ of the thread diameter, and the piercing needles 20 of the outer plates may be spaced therefrom by a distance of 0.08 mm. corresponding to about half the thread diameter. Piercing needle 20 of the center plate then bites from below into the foremost thread 14*a* disposed at a relatively low level in FIG. 15, and the piercing needles 20 of the two outer plates bite into it from above. As these two piercing needles are located at a smaller distance from the base edge, there is no risk that these piercing needles bite into the thread 14*b* which follows. The situation is the reverse in FIG. 16. The piercing needle 20 of the center plate 16 bites from above into the thread 14*b* that is next in line, which is now the foremost thread, and the somewhat set back piercing needles 20 of the outer plate bite into it from below, as the thread 14*c* that now follows is located at a low level.

FIGS. 17 to 19 show an illustrative embodiment, in which a plate 16 with two piercing needles 20 and additionally one or two further plates 19 without piercing needles on steps 22 are used. Plates 19 merely have a recess and at the ends thereof respectively the steps 22, which are engaged by the threads 14*a* or 14*b*, respectively. This embodiment suffices in a case where the threads in the array 14 are loosely woven in.

FIGS. 20 to 22 show an illustrative embodiment with one stepped plate 24. The stepped plate 24 includes three recesses 25 of varying depth on the front edge. By displacement of the plate, one of the recesses 25 respectively may become effective in the gap of frame 10. The deepest recess 25 that is effective in the position of FIG. 20 is in alignment with the base edge 28 of plate 16. In FIG. 21, the stepped plate 24 is displaced upwards. The threads to be separated are now not engaging the base edge 28 of plate 16 but, rather, the lower recess 25 of the stepped plate 24, so that now threads having a smaller diameter may be separated. In the position shown in FIG. 22, the stepped plate is displaced downwardly, so that the more shallow, upper recess 25 becomes effective in gap 12 and threads having yet smaller diameters can be separated. The stepped plate 24 can be utilized in cases, in which alternatingly the upper and lower piercing needles are used, as well as also in cases, in which the thread to be separated is being cut into from above and from below simultaneously.

We claim:

1. A separator for successively seizing threads held in an array, comprising a frame having drive means for moving the frame toward and away from said array, at least one plate having means for guided movement in said frame for seizing a thread in said array wherein said plate includes a piercing needle for piercing said thread and seizing said thread.

2. A separator as set forth in claim 1, wherein said plate includes two piercing needles disposed at a distance from one another and pointing towards one another.

3. A separator as set forth in claim 2 wherein said plate has a recess defining a base edge and said piercing needles are disposed at a distance of about $\frac{3}{4}$ to $\frac{1}{2}$ of a diameter of said thread from said base edge whereby said thread engages said base edge of said plate when said piercing needles pierce said thread.

4. A separator as set forth in claim 3 wherein at least two plates are provided with one plate having piercing needles being disposed at a distance of about $\frac{3}{4}$ of a diameter of said thread and the other plate having piercing needles at a distance of about $\frac{1}{2}$ of a diameter of a thread from said base edge, whereby said piercing needles disposed closer to said base edge will pierce the thread to be seized from one side and said piercing needles disposed further from said base edge will pierce the thread from the opposite side.

5. A separator as set forth in claim 2, wherein said piercing needles are pointed at a cone angle of approximately 30°.

6. A separator as set forth in claim 1, wherein the free length of said piercing needle is less than the diameter of a thread to be pierced.

* * * * *